US009773455B2

(12) United States Patent
Chung et al.

(10) Patent No.: US 9,773,455 B2
(45) Date of Patent: Sep. 26, 2017

(54) ORGANIC LIGHT EMITTING DISPLAY DEVICE FOR COMPENSATION OF PIXEL DEGRADATION AND DRIVING METHOD THEREOF

(71) Applicant: SAMSUNG DISPLAY CO., LTD., Yongin, Gyeonggi-Do (KR)

(72) Inventors: Gun-Hee Chung, Yongin (KR); Hyun-Seuk Yoo, Yongin (KR); Jun-Jin Kong, Yongin (KR); Hong-Rak Son, Yongin (KR); Madhusudan Singh, Yongin (KR); Jong-Woong Park, Yongin (KR); Joo-Hyung Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 11 days.

(21) Appl. No.: 14/584,408

(22) Filed: Dec. 29, 2014

(65) Prior Publication Data

US 2015/0194096 A1 Jul. 9, 2015

(30) Foreign Application Priority Data

Jan. 8, 2014 (KR) ..... 10-2014-0002219

(51) Int. Cl.
*G09G 3/3275* (2016.01)
*G09G 3/3225* (2016.01)

(52) U.S. Cl.
CPC ..... *G09G 3/3275* (2013.01); *G09G 3/3225* (2013.01); *G09G 2320/048* (2013.01); *G09G 2340/02* (2013.01)

(58) Field of Classification Search
CPC ..... G09G 3/32; G09G 3/3208; G09G 3/3275; G09G 3/3225; G09G 2320/043; G09G 2320/045; G09G 2320/048; G09G 2340/02; H03M 7/30; H03M 7/3059; H03M 7/6064; H03M 7/6088; H03M 7/6094; G06F 12/02; G06F 2212/401; H04N 19/134; H04N 19/136; H04N 19/167; H04N 19/169;
(Continued)

(56) References Cited

U.S. PATENT DOCUMENTS 9,019,319 B2 * 4/2015 Wakatsuki ..... G09G 3/22 345/690
2002/0033783 A1 * 3/2002 Koyama ..... G09G 3/3233 345/82
(Continued)

FOREIGN PATENT DOCUMENTS

KR 10-2009-0058694 6/2009
KR 10-2011-0078716 7/2011
KR 10-2012-0094736 8/2012

*Primary Examiner* — Keith Crawley
(74) *Attorney, Agent, or Firm* — Lewis Roca Rothgerber Christie LLP

(57) ABSTRACT

An organic light emitting display device includes a plurality of pixels in a display area; a data driver configured to supply a data signal to the pixels; and a data converter configured to output a correction image data utilized in generation of the data signal, and the data converter is configured to generate a stress data corresponding to an input image data, to accumulate and store at least a portion of the stress data in a compressed state, and to generate the correction image data obtained by correcting the input image data according to the accumulated stress data.

20 Claims, 5 Drawing Sheets

(58) Field of Classification Search
CPC .... H04N 19/17; H04N 19/172; H04N 19/423; H04N 19/426; H04N 19/65; H04N 19/66; H04N 19/67
See application file for complete search history.

(56) References Cited

U.S. PATENT DOCUMENTS

| | | | | |
|---|---|---|---|---|
| 2003/0071804 | A1* | 4/2003 | Yamazaki | G09G 3/3233 345/204 |
| 2006/0011846 | A1* | 1/2006 | Ozaki | G09G 3/20 250/363.03 |
| 2006/0279490 | A1 | 12/2006 | Park et al. | |
| 2007/0229480 | A1* | 10/2007 | Ookawara | G09G 3/20 345/204 |
| 2009/0146926 | A1 | 6/2009 | Sung et al. | |
| 2009/0147032 | A1* | 6/2009 | Kim | G09G 3/3225 345/690 |
| 2010/0003015 | A1* | 1/2010 | Rodriguez | H04N 21/26275 386/220 |
| 2010/0007656 | A1* | 1/2010 | Okamoto | G09G 3/3233 345/214 |
| 2011/0150433 | A1* | 6/2011 | Alexandrov | H04N 5/91 386/328 |
| 2012/0212516 | A1 | 8/2012 | Ahn et al. | |
| 2013/0063458 | A1* | 3/2013 | Shido | G09G 5/24 345/545 |
| 2014/0177957 | A1* | 6/2014 | Clark | G06T 9/00 382/166 |
| 2015/0187328 | A1* | 7/2015 | Kim | G09G 5/02 345/690 |
| 2015/0356899 | A1* | 12/2015 | Yamanaka | G09G 3/3225 345/690 |

* cited by examiner

FIG. 4A $$\begin{bmatrix} S_{11} & S_{12} & S_{13} & S_{14} \\ S_{21} & S_{22} & S_{23} & S_{24} \\ S_{31} & S_{32} & S_{33} & S_{34} \\ S_{41} & S_{42} & S_{43} & S_{44} \end{bmatrix} \cdot T = \begin{bmatrix} C_{11} & C_{12} & C_{13} & C_{14} \\ C_{21} & C_{22} & C_{23} & C_{24} \\ C_{31} & C_{32} & C_{33} & C_{34} \\ C_{41} & C_{42} & C_{43} & C_{44} \end{bmatrix}$$

FIG. 4B $$\begin{bmatrix} C_{11} & C_{12} & C_{13} & C_{14} \\ C_{21} & C_{22} & C_{23} & C_{24} \\ C_{31} & C_{32} & C_{33} & C_{34} \\ C_{41} & C_{42} & C_{43} & C_{44} \end{bmatrix} \Rightarrow \begin{bmatrix} C_{a1b1} & C_{a1b2} \\ C_{a2b1} & C_{a2b2} \end{bmatrix}$$

ORGANIC LIGHT EMITTING DISPLAY DEVICE FOR COMPENSATION OF PIXEL DEGRADATION AND DRIVING METHOD THEREOF

CROSS-REFERENCE TO RELATED APPLICATION

This application claims priority to and the benefit of Korean Patent Application No. 10-2014-0002219, filed on Jan. 8, 2014, in the Korean Intellectual Property Office, the entire content of which is incorporated herein by reference in its entirety.

BACKGROUND

1. Field

Aspects of embodiments of the present invention relate to an organic light emitting display device and a driving method thereof.

2. Description of Related Art

Recently, there have been developed various types (or kinds) of flat panel display devices capable of reducing the weight and volume of cathode ray tubes, which are disadvantages. The flat panel display devices include a liquid crystal display device, a field emission display device, a plasma display panel, an organic light emitting display device, and the like.

Among these flat panel display devices, an organic light emitting display device displays images using (or utilizing) organic light emitting diodes that emit light through recombination of electrons and holes. An organic light emitting display may have a faster (e.g., fast) response speed and may be driven with lower (e.g., low) power consumption.

SUMMARY

Aspects of embodiments are directed toward an organic light emitting display device and a driving method thereof, which can compensate for degradation of pixels by more efficiently storing a stress data corresponding to the emission amount of each pixel.

According to an aspect of the present invention, there is provided an organic light emitting display device, including: a plurality of pixels in a display area; a data driver configured to supply a data signal to the pixels; and a data converter configured to output a correction image data utilized in generation of the data signal, and the data converter is configured to generate a stress data corresponding to an input image data, to accumulate and store at least a portion of the stress data in a compressed state, and to generate the correction image data obtained by correcting the input image data according to the accumulated stress data.

The data converter may include a gray-stress converter configured to generate the stress data corresponding to the input image data; a first compressor configured to compress the stress data; a memory unit configured to accumulate and store the stress data compressed by the first compressor as an accumulated compression stress data; a first decompressor configured to generate an accumulation stress data by decompressing the accumulated compression stress data stored in the memory unit; and a data compensation unit configured to generate the correction image data obtained by correcting the input image data according to the accumulation stress data.

The gray-stress converter may be configured to detect the stress data corresponding to the input image data through mapping between the input image data and the stress data.

The first compressor may be configured to compress the stress data utilizing a linear compression method.

The first compressor may be configured to compress the stress data for every frame.

The memory unit may include a first memory configured to store a stress data compressed by the first compressor for a period; and a second memory configured to continuously accumulate and store the compressed stress data.

The first memory may be a volatile memory, and the second memory may be a non-volatile memory.

The first decompressor may be configured to generate the accumulation stress data by decompressing the accumulated compression stress data for every frame.

The data compensation unit may be configured to calculate a correction value of the input image data, utilizing a function determined with respect to the accumulation stress data.

The data converter may further include a logo detector configured to detect a logo area, utilizing the accumulated compression stress data or the accumulation stress data, and to control the stress data corresponding to the logo area to be separately accumulated and stored; and a multiplexer configured to selectively output, to the data compensation unit, an accumulation stress data corresponding to the logo area and an accumulation stress data corresponding to a non-logo area.

The memory unit may include a first memory configured to store a stress data compressed by the first compressor for a period; a third memory configured to store a compression stress data or a non-compression stress data corresponding to the logo area for a period; and a second memory configured to continuously accumulate and store the compression stress data or the non-compression stress data supplied via the first and third memories.

The data converter may further include a second compressor configured to compress the stress data corresponding to the logo area and to output the compressed stress data to the memory unit; and a second decompressor configured to generate an accumulation stress data by decompressing the accumulated compression stress data corresponding to the logo area, stored in the memory unit, and to supply the generated accumulation stress data to the multiplexer.

The data converter may be configured to accumulate and store the stress data in a compressed or a non-compressed state by distinguishing a logo area from a non-logo area, and to generate the correction image data obtained by correcting the input image data according to the accumulated stress data.

According to an aspect of the present invention, there is provided a method of driving an organic light emitting display device, the method including: generating a stress data corresponding to an input image data; generating a compression stress data by compressing the stress data; generating an accumulated compression stress data by accumulating and storing the compression stress data; generating an accumulation stress data by decompressing the accumulated compression stress data; correcting the input image data according to the accumulation stress data, and outputting the corrected input image data as a correction image data; and generating a data signal corresponding to the correction image data, and supplying the generated data signal to pixels.

The generating of the stress data may include detecting the stress data corresponding to the input image data through mapping between the input image data and the stress data.

The generating of the compression stress data may include compressing the stress data utilizing a linear compression method.

The correcting of the input image data may include calculating a correction value of the input image data utilizing a function determined with respect to the accumulation stress data.

The method may further include detecting a logo area, utilizing the accumulated compression stress data or the accumulation stress data, and accumulating and storing the stress data corresponding to the logo area to be separated from a stress data in a non-logo area.

The stress data corresponding to the logo area may be accumulated and stored in a non-compressed state to be utilized in generation of the correction image data.

The stress data corresponding to the logo area may be compressed at a compression ratio different from that of the stress data corresponding to a non-logo area and then accumulated and stored, and the accumulated compression stress data may be decompressed to be utilized in the generation of the correction image data.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be more thorough and complete, and will more fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

FIGS. 4A and 4B are diagrams illustrating a compressing process of a stress data according to the embodiment of the present invention.

DETAILED DESCRIPTION

Figure 1:
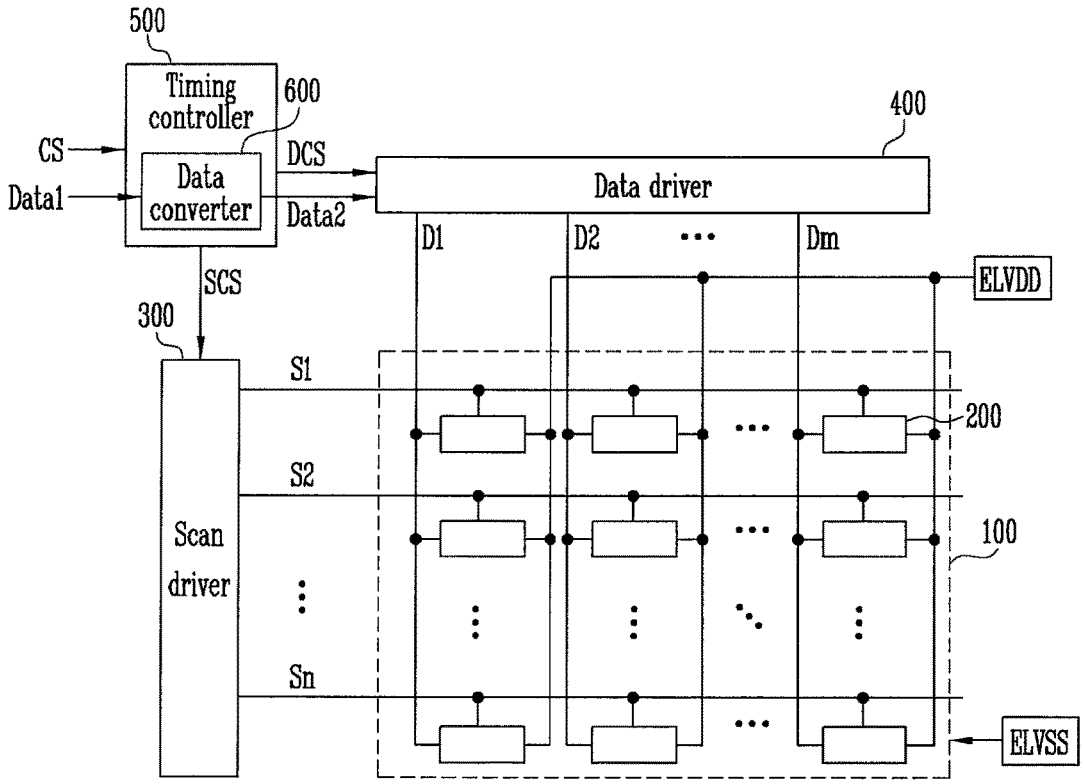
FIG. 1 is a block diagram illustrating an organic light emitting display device according to an embodiment of the present invention.

Hereinafter, certain example embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to the complete understanding of the invention may be omitted for clarity. Also, like reference numerals refer to like elements throughout.

Figure 2:
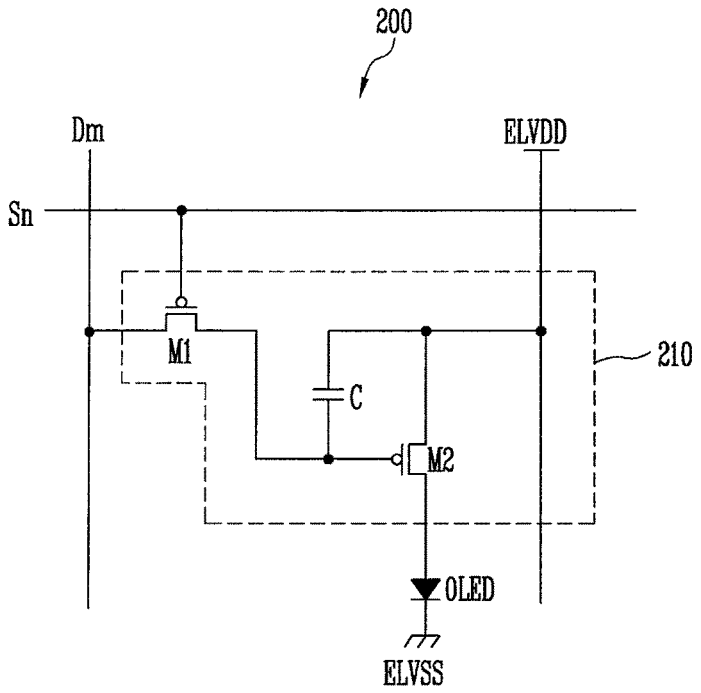
FIG. 2 is a circuit diagram illustrating a pixel according to an embodiment of the present invention.

FIG. 1 is a block diagram illustrating an organic light emitting display device according to an embodiment of the present invention. FIG. 2 is a circuit diagram illustrating a pixel according to an embodiment of the present invention. For convenience of illustration, a pixel coupled to an n-th scan line Sn and an m-th data line Dm is shown in FIG. 2.

First, referring to FIG. 1, the organic light emitting display device according to this embodiment includes a plurality of pixels 200 disposed in a display area 100, a scan driver 300 and a data driver 400, which are configured to drive the pixels 200, and a timing controller 500 configured to drive the scan driver 300 and the data driver 400.

The organic light emitting display device according to this embodiment further includes a data converter 600 configured to generate a correction image data Data2, using (or utilizing) an input image data Data1, and output the correction image data Data2 to the data driver 400. The data converter 600, for example, may be configured inside the timing controller 500. However, the present invention is not limited thereto, and the data driver 600 may be provided at an outside of the timing controller 500.

Scan lines S1 to Sn and data lines D1 to Dm, which are arranged in directions intersecting (or crossing) each other, and the plurality of pixels 200 respectively disposed at intersection (or crossing) portions of the scan lines S1 to Sn and the data lines D1 to Dm are provided in the display area 100.

Each pixel 200 includes an organic light emitting diode which emits light with a luminance corresponding to a data signal supplied from the data lines D1 to Dm. Each pixel 200 may further include a pixel circuit configured to control the organic light emitting diode, and the like.

For example, each pixel 200, as shown in FIG. 2, may include an organic light emitting diode OLED, and a pixel circuit 210 coupled to the organic light emitting diode OLED.

A first electrode (e.g., an anode electrode) of the organic light emitting diode OLED is coupled to the pixel circuit 210, and a second electrode (e.g., a cathode electrode) of the organic light emitting diode OLED is coupled to a second power source ELVSS. The second power source ELVSS, for example, may be set as a low-potential power source (e.g., a low voltage source). The organic light emitting diode OLED emits light with a luminance corresponding to the amount of current supplied from the pixel circuit 210.

The pixel circuit 210 stores a data signal supplied from the data line Dm when a scan signal is supplied from the scan line Sn, and controls driving current supplied to the organic light emitting diode OLED, which corresponds to the stored data signal. To this end, in one embodiment the pixel circuit 210 includes a first transistor M1, a second transistor M2 and a storage capacitor C.

The first transistor M1 is coupled between the data line Dm and a first electrode of the storage capacitor C, and a gate electrode of the first transistor M1 is coupled to the scan line Sn. The first transistor M1 is turned on when the scan signal is supplied from the scan line Sn, to supply the data signal supplied from the data line Dm to the storage capacitor C. In one embodiment, a voltage corresponding to the data signal is charged in the storage capacitor C.

The second transistor M2 is coupled between a first power source ELVDD and the organic light emitting diode OLED, and a gate electrode of the second transistor M2 is coupled to the first electrode of the storage capacitor C. The second transistor M2 controls driving current supplied from the first power source ELVDD to the second power source ELVSS via the organic light emitting diode OLED. The driving current corresponds to a voltage supplied to the gate electrode of the second transistor M2, i.e., a voltage corresponding to the data signal. Then, the organic light emitting diode OLED emits light with a luminance corresponding to the driving current, and does not emit light when a data signal corresponding to a black gray (e.g., a black gray level) is supplied. In one embodiment, the first power source ELVDD may be set as a high-potential pixel power source (e.g., a high voltage source) having a potential higher than that of the second power source ELVSS.

The storage capacitor C stores a voltage corresponding to the data signal supplied via the first transistor M1, and maintains the stored voltage until a data of a next frame is supplied.

According to one embodiment, the pixel 200 receives a data signal every frame, and emits light with a luminance corresponding to the data signal, thereby displaying grays (e.g., gray levels).

As time elapses, the organic light emitting diode OLED may become degraded, and therefore, the emission efficiency of the organic light emitting diode OLED may be lowered. Accordingly, when the same data signal is supplied, the organic light emitting diode may emit light with a different luminance depending on the degree of degradation.

For example, the organic light emitting diode OLED may be degraded to a different extent depending on an accumulated emission amount (accumulated emission luminance and emission time). If the degradation of the organic light emitting diode OLED is not properly compensated, the luminance may be entirely lowered, and the image quality may be deteriorated due to the occurrence of image sticking, etc.

Thus, aspects of the present invention provide a plan for efficiently compensating for degradation of the pixel 200, caused by the degradation of the organic light emitting diode OLED, etc. This will be described in further detail later.

Referring back to FIG. 1, the scan driver 300 generates a scan signal, corresponding to (or in accordance with) a scan control signal SCS supplied from the timing controller 500, and supplies the generated scan signal to the scan lines S1 to Sn. If (or when) the scan signal is supplied to the scan lines S1 to Sn, pixels 200 are selected for each horizontal line.

The data driver 400 generates a data signal, corresponding to (or in accordance with) a data control signal DCS supplied from the timing controller 500 and a correction image data Data2, and supplies the generated data signal to the data lines D1 to Dm. For example, in one embodiment of the present invention, the data driver 400 generates a data signal, using (or utilizing) the correction image data Data2 output from the data converter 600.

The timing controller 500 generates a scan control signal SCS and a data control signal DCS, corresponding to (or in accordance with) a control signal CS including a vertical/horizontal synchronization signal, a clock signal, an enable signal, etc., and supplies the generated scan and data control signals SCS and DCS to the respective scan and data drivers 300 and 400. The timing controller 500, for example, may have the data converter 600 therein.

The data converter 600 receives an input image data Data1 supplied from an outside, and generates a correction image data Data2 by correcting the input image data Data1 so that the degradation of the pixel 200 can be compensated. The correction image data Data2 generated in the data converter 600 is supplied to the data driver 400.

For example, the data converter 600 according to an embodiment of the present invention generates a stress data corresponding to the input image data Data1, accumulates and stores the generated stress data in a state in which at least one portion of the stress data is compressed, and generates a correction image data Data2 obtained by correcting the input image data Data1, corresponding to (or in accordance with) the accumulated stress data. According to an aspect of the present invention, the compressed state of at least one portion of the stress data reduces the amount of memory occupied by the stress data.

Accordingly, in embodiments of the present invention, it is possible to improve image quality by compensating for degradation of the pixels and to reduce the capacity of a memory for accumulating and storing the stress data used (or utilized) in the compensation of degradation.

Figure 3:
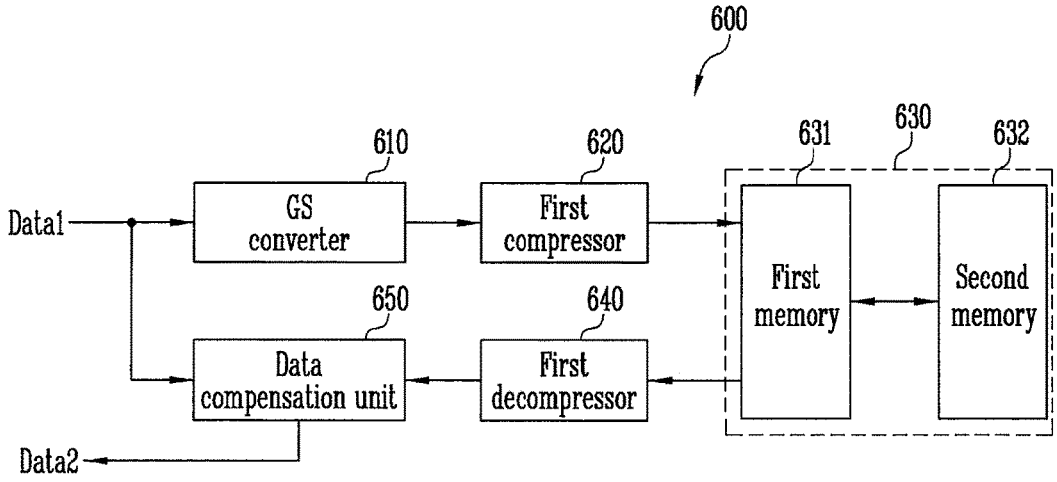
FIG. 3 is a block diagram illustrating a data converter according to an embodiment of the present invention.
Figure 5:
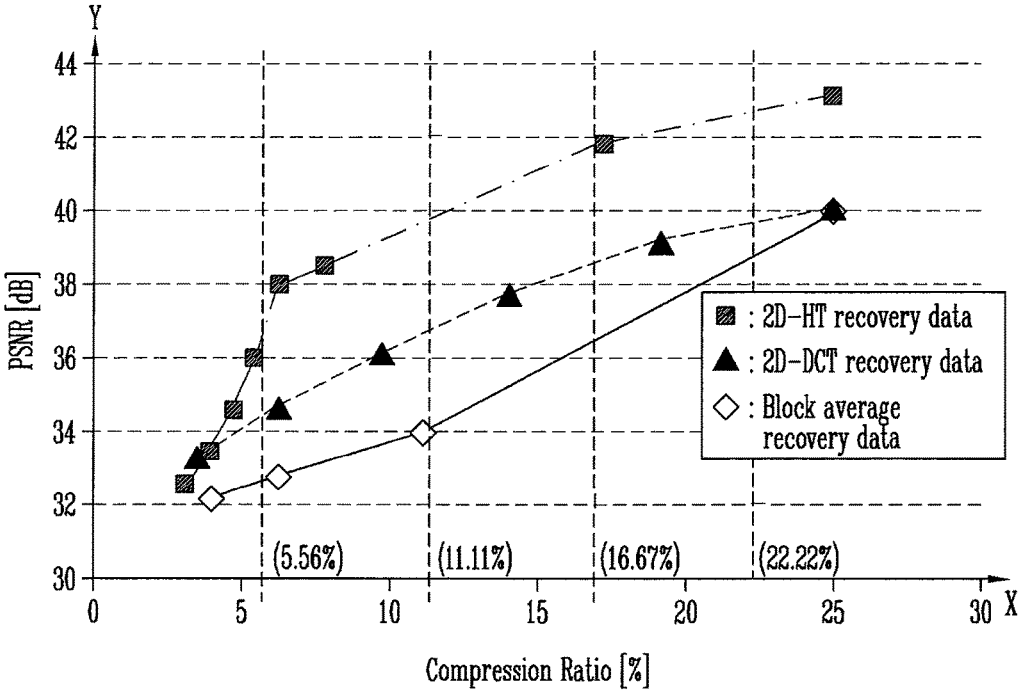
FIG. 5 is a graph illustrating a peak signal-to-noise ratio (PSNR) according to a compression ratio of the stress data.

FIG. 3 is a block diagram illustrating a data converter according to an embodiment of the present invention. FIGS. 4A and 4B are diagrams illustrating a compressing process of a stress data according to an embodiment of the present invention. FIG. 5 is a graph illustrating a peak signal-to-noise ratio (PSNR) according to a compression ratio of the stress data.

First, referring to FIG. 3, the data converter 600 according to this embodiment generates a stress data corresponding to an input image data Data1, accumulates and stores the generated stress data in a state in which at least one portion of the stress data is compressed, and generates a correction image data Data2 by correcting the input image data Data1, corresponding to (or in accordance with) the stress data generated by decompressing the compressed stress data, so that the degradation of the pixels is compensated.

To this end, the data converter 600 includes a gray-stress converter (hereinafter, referred to as a GS converter) 610, a first compressor 620, a memory unit 630, a first decompressor 640 and a data compensation unit 650.

The GS converter 610 generates a stress data, corresponding to the input image data Data1. The input image data Data1 includes gray information (e.g., gray level information) of each pixel, and the GS converter 610 generates a stress data obtained by converting the degree of stress applied to each pixel, using (or utilizing) the gray information (e.g., gray level information). For example, the GS converter 610 may detect a stress data corresponding to the input image data Data1 through mapping between the input image data Data1 and the stress data. In one embodiment, a mapping table or the like, which is determined (e.g., previously determined) by an experiment to be suitable for a corresponding panel, may be used (or utilized) in the mapping between the input image data Data1 and the stress data.

The first compressor 620 generates a compression stress data by compressing the stress data, and supplies the generated compression stress data to the memory unit 630. For example, in this embodiment, the first compressor 620 may compress the stress data through a linear compression method using (or utilizing) discrete cosine transform (hereinafter, referred to as DCT), Hadamard transform, Haar transform, etc.

For example, the first compressor 620 may divide the pixels into blocks (e.g., predetermined blocks) according to the positions of the pixels, and for each block dispose a stress data $S_{ij}$ (i and j are natural numbers) in a matrix as shown in FIG. 4A, and then perform linear transform on the stress data through multiplication conversion of the matrix.

T of FIG. 4A refers to (or means) a matrix (e.g., a predetermined matrix) used (or utilized) in the multiplication conversion.

For example, the first compressor 620 may perform DCT for each block of the pixels so that the stress data $S_{ij}$ is reconfigured as a signal in a frequency domain from a signal in a spatial domain.

Subsequently, the first compressor 620 obtains only major values through truncation as shown in FIG. 4B, so that it is possible to generate a compression stress data $C_{aibj}$ by compressing the linear-transformed stress data.

For example, the first compressor 620 may obtain some major values with high intensity in a power spectrum among the stress data $C_{ij}$ reconfigured as the signal in the frequency domain, thereby generating the compression stress data $C_{aibj}$.

In case of a linear compression method using (or utilizing) linear transform such as the DCT, the original data can be reconfigured as a preferred (or desired) approximate value when the compressed data is inversely transformed.

For example, in the graph of the PSNR according to a compression ratio of the stress data as shown in FIG. 5, it can be seen that the recovery data obtained by compressing a stress data with a compression ratio of 25% or more and then decompressing the compressed stress data secures a PSNR of 40 dB or more, as compared with a non-compression data, i.e., the original data.

Here, the graph of FIG. 5 illustrates a result obtained by performing simulation, based on an International Electrotechnical Commission (IEC) standard moving image when assuming that the stress data $S_{ij}$ is sampled and compressed at a frequency of 1 Hz.

The X-axis of the graph represents (or means) a ratio of a data remaining after the compression to the original data $$\left(\text{e.g., } \frac{\text{uncompressed_data_size}}{\text{original_data_size}} \times 100\right).$$

As the compression ratio increases (or becomes large), the amount of the remaining data becomes larger, and a memory having a larger capacity is used (or utilized) to store the remaining data. The Y-axis of the graph represents (or means) a PSNR value which reflects a similarity degree of the original data to the recovery data. As the PSNR value increases (or becomes high), the data after the compression is recovered more similarly to the original data.

A 2D-HT recovery data refers to (or means) a recovery data obtained by decompressing a stress data (or accumulated compression stress data) compressed through 2D Hadamard transform, and a 2D-DCT recovery data refers to (or means) a recovery data obtained by decompressing a stress data (or accumulated compression stress data) compressed through 2D DCT transform. In addition, a block average recovery data refers to (or means) a recovery data obtained by decompressing a stress data (or accumulated compression stress data) compressed as a representative value (e.g., an average value) of stress data for each block.

Referring to FIG. 5, all the recovery data respectively obtained by decompressing the stress data compressed through the three different linear compression methods have a PSNR of 40 dB or more at a compression ratio of 25% or more. Thus, it can be seen that the recovery data having a relatively high degree of similarity to the original data may be secured when the stress data is linearly compressed and then recovered.

Accordingly, although the stress data is compressed and then accumulated and stored, and the accumulated compression data is decompressed to be used (or utilized) in data conversion for degradation compensation, the degradation of the pixels can be more effectively compensated.

The compression ratio and the memory capacity related thereto may be controlled by considering a desired PSNR value or a total accumulation use (or utilization) time of a panel of which degradation can be compensated.

In one embodiment, the first compressor 620 may compress the stress data $S_{ij}$ every frame (e.g., for every frame). However, the first compressor 620 may not necessarily be driven at a high speed for each frame. For example, the first compressor 620 may compress (e.g., be set to compress) the stress data every frame (e.g., for every predetermined frame). As with the simulation condition of the graph shown in FIG. 5, the first compressor 620 may sample (e.g., may be set to sample) the stress data $S_{ij}$ at a frequency of 1 Hz.

Referring back to FIG. 3, the stress data compressed by the first compressor 620 is supplied to the memory unit 630 to be accumulated and stored.

For example, when a compression stress data is generated for each block of the pixels, the compression stress data for each block may be continuously accumulated and stored in the memory unit 630 by being added to the compression stress data of the corresponding block, which has been generated (e.g., previously generated) and then accumulated and stored in the memory unit 630. Accordingly, the accumulated compression stress data can be generated.

The memory unit 630 may be configured to include a plurality of memories. For example, the memory unit 630 may include a first memory 631 configured to store a stress data compressed by the first compressor 620 for a period (e.g., a predetermined period), and a second memory 632 configured to continuously accumulate and store the compressed stress data.

For example, the stress data compressed by the first compressor 620 may be supplied to the second memory 632 via the first memory 631 to be accumulated and stored. In one embodiment, the first memory 631 may be configured as a volatile memory, and the second memory 632 may be configured as a nonvolatile memory.

The compression stress data stored in the first memory 631 may be supplied to the second memory 632 for each frame (e.g., each predetermined frame), or may be supplied to the second memory 632 at the time when the organic light emitting display device is turned on/off. That is, the time when the compression stress data stored in the first memory 631 is supplied to the second memory 632 may be variously modified.

The first decompressor 640 generates an accumulation stress data by decompressing and recovering the accumulated compression stress data stored in the memory unit 630. The accumulation stress data generated in the first decompressor 640 is supplied to the data compensation unit 650 so as to be used (or utilized) in data correction for degradation compensation. In one embodiment, the first decompressor 640 generates, in real time, an accumulation stress data by decompressing the accumulated compression stress data every frame (e.g., for every frame), so that the data correction is performed in real time.

The data compensation unit 650 receives an input image data Data1 supplied from an outside, and receives an accumulation stress data supplied from the first decompressor 640. The data compensation unit 650 corrects the input image data Data1, corresponding to (or in accordance with) the accumulation stress data, thereby generating a correction image data Data2.

For example, the data compensation unit 650 may calculate a correction value of the input image data Data1, using (or utilizing) a function determined (e.g., previously set) with respect to the accumulation stress data, correct the input image data Data1 by applying the calculated correction value, and then output the corrected input image data Data1 as the correction image data Data2.

The function for generating the correction image data Data2 may be determined or optimized (e.g., previously set to be optimized) according to channel characteristics, and then stored. For example, the function for generating the correction image data Data2 may estimate (e.g., be set to estimate) the degree of degradation of the pixels according to the accumulation stress data as a value corresponding to the accumulated emission amount of the pixels and to calculate a correction value which enables the deterioration of luminance to be compensated.

The correction image data Data2 generated in the data compensation unit 650 is used (or utilized) to generate a data signal. Thus, each pixel receives a data signal for compensating for the degradation thereof, and emits light with a luminance corresponding to the data signal. Accordingly, it is possible to reduce image quality deterioration (or prevent image quality from being deteriorated) due to the degradation of the pixels.

A driving method of the organic light emitting display device having the data converter 600 according to this embodiment includes generating a stress data corresponding to an input image data Data1; generating a compression stress data by compressing the stress data; generating an accumulated compression stress data by accumulating and storing the compression stress data; generating an accumulation stress data by decompressing the accumulated compression stress data; correcting the input image data Data1, corresponding to (or in accordance with) the accumulation stress data, and outputting the corrected input image data Data1 as a correction image data Data2; and generating a data signal, corresponding to (or in accordance with) the correction image data Data2, and supplying the data signal to the pixels 200.

Accordingly, it is possible to improve image quality by compensating for degradation of the pixels and to reduce the capacity of the memory used (or utilized) in storing the stress data used (or utilized) for degradation compensation.

Figure 6:
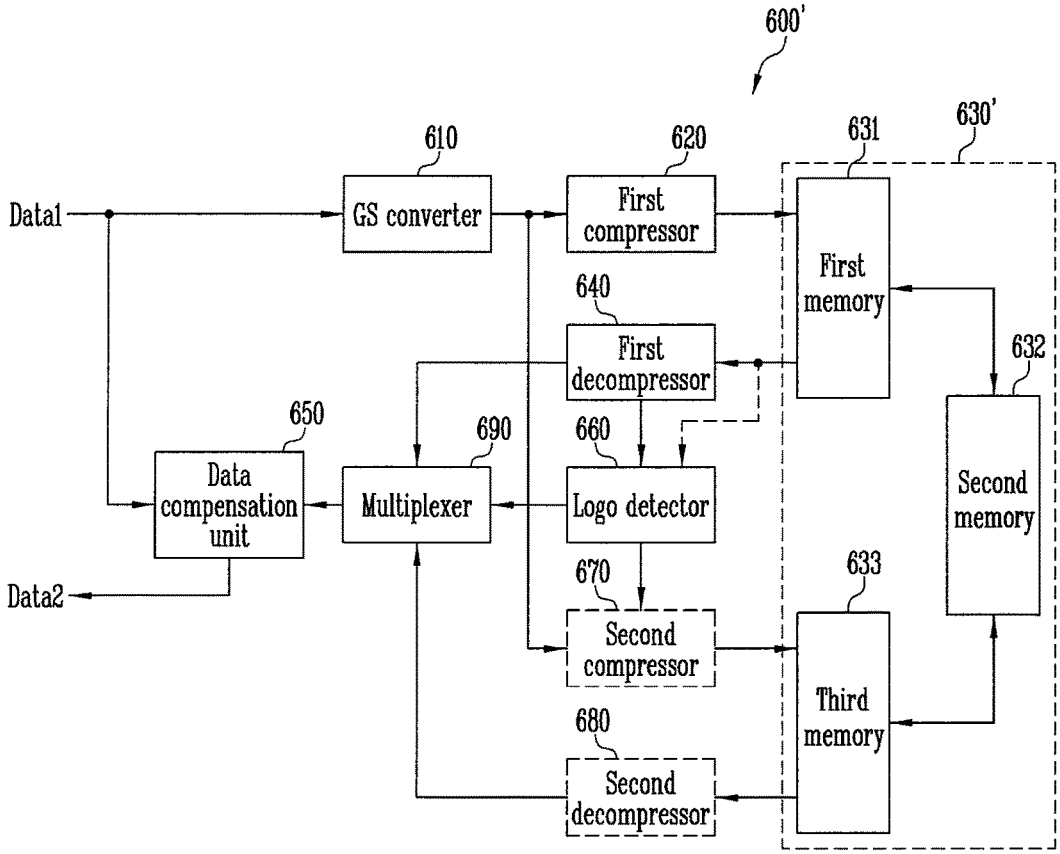
FIG. 6 is a block diagram illustrating a data converter according to another embodiment of the present invention.

FIG. 6 is a block diagram illustrating a data converter according to another embodiment of the present invention. For convenience, components similar or identical to those of FIG. 3 are designated by like reference numerals, and their detailed descriptions may be omitted.

Referring to FIG. 6, the data converter 600' according to this embodiment accumulates and stores a stress data in a compressed or non-compressed state by distinguishing a specific area such as a logo area from the other area (e.g., the non-logo area), and generates a correction image data Data2 obtained by correcting an input image data Data1, corresponding to (or in accordance with) the accumulated stress data.

For example, the data converter 600' according to this embodiment may compress a stress data in a specific area which requires degradation compensation of higher (or high) accuracy, such as a logo area, at a compression ratio different from that of a stress data in the other area (e.g., the non-logo area), and then accumulate and store the compressed stress data. Alternatively, the data converter 600' according to this embodiment may accumulate and store a stress data in the non-compressed state to be closer (e.g., close) to the original data.

For convenience, the specific area which requires an accuracy different from that of the other area (e.g., the non-logo area) will be referred to as a logo area, however the present invention is not necessarily limited thereto. For example, the specific area may be modified as another area (e.g., another predetermined area) other than the logo area.

The data converter 600' according to this embodiment further includes a logo detector 660 and a multiplexer 690. A memory unit 630' may further include a third memory 633 configured to temporarily store a stress data in a logo area or a compression stress data in the logo area. Although it has been illustrated in FIG. 4 that the first and third memories 631 and 633 are separated from each other, the present invention is not limited thereto. For example, the first and third memories 631 and 633 may be configured so that the areas of the first and third memories 631 and 633 are separated in one memory.

When compressing and storing the stress data in the logo area, the data converter 600' may further include a second compressor 670 and a second decompressor 680. However, when the stress data in the logo area is stored in the non-compressed state, the second compressor 670 and the second decompressor 680 may be omitted.

The logo detector 660 receives an accumulation stress data decompressed from the first decompressor 640 or directly receives an accumulation stress data supplied from the memory unit 630'. The logo detector 660 detects a logo area, using (or utilizing) the accumulation stress data or accumulated compression data, and controls a stress data corresponding to the logo area to be accumulated and stored separately from a stress data in the other area (e.g., the non-logo area).

For example, the logo detector 660 may determine (or decide), as the logo area, an area where the accumulation stress data or accumulated compression stress data has a limit value (e.g., a predetermined limit value) or more.

The logo detector 660 may control the stress data in the determined (or decided) logo area to be supplied from the GS converter 610 to the second compressor 670, be compressed at a ratio different from that of a stress data in the other area (e.g., the non-logo area) and then separately accumulated and stored in an area (e.g., a predetermined area) of the memory unit 630'.

In another embodiment, the logo detector 660 may control the stress data in the logo area to be directly supplied from the GS converter 610 to the memory unit 630' and then accumulated and stored in the non-compressed state in an area (e.g., a predetermined area) assigned for the logo area.

In one embodiment, the logo detector 660 supplies, to the multiplexer 690, a control signal corresponding to the logo area or non-logo area (the other area except the logo area), to control an accumulation stress data corresponding to the area to be supplied to the data compensation unit 650 through the multiplexer 690.

The second compressor 670 compresses a stress data corresponding to the logo area, and outputs the compressed stress data to the memory unit 630'. For example, the second compressor 670 compresses the stress data by applying a compression ratio different from that of the first compressor 620. For example, the second compressor 670 may supply, to the memory unit 630', the stress data in the logo area, compressed to a low extent closer to the original data.

In one embodiment, the compression stress data in the logo area, supplied to the memory unit 630', is temporarily stored and/or accumulated in the third memory 633 to be stored separately from a compression stress data in the other area (e.g., the non-logo area) and then continuously accumulated and stored in an area assigned by the second memory 632.

The memory unit 630' according to this embodiment may include the first memory 631 configured to temporarily store a stress data compressed by the first compressor 620 for a period (e.g., a predetermined period), the third memory 633 configured to temporarily store the compression stress data in the logo area, compressed by the second compressor 670, or the stress data in the logo area, supplied from the GS converter 610 for a period (e.g., a predetermined period), and the second memory 632 configured to continuously accumulate and store the compression stress data or non-compression stress data in the non-logo area and the logo area, supplied via the first and third memories 631 and 633.

The second decompressor 680 generates an accumulation stress data in the logo area by decompressing the accumulated compression stress data in the logo area, stored in the memory unit 630', and supplies the generated accumulation stress data to the multiplexer 690.

When the second compressor 670 and the second decompressor 680 are omitted, the accumulation stress data in the logo area, stored in the memory unit 630', i.e., the accumulation value of the non-compression stress data in the logo area, may be directly supplied to the multiplexer 690.

In one embodiment, the multiplexer 690 selectively outputs, to the data compensation unit 650, the accumulation stress data in the non-logo area, supplied from the first decompressor 640 or the accumulation stress data in the logo area, supplied from the second decompressor 680 or the memory unit 630', corresponding to (or in accordance with) the control signal from the logo detector 660.

Then, the data compensation unit 650 generates and outputs a correction image data Data2 obtained by correcting the input image data Data1, using (or utilizing) the accumulation stress data in the non-logo area or the logo area, supplied from the multiplexer 690.

When the data converter 600' according to this embodiment is applied as described above, it is possible to detect a specific area which requires higher-accuracy (e.g., high-accuracy) degradation compensation, such as a logo area, using (or utilizing) the accumulated stress data. The stress data corresponding to the specific area is compressed or non-compressed to an extent lower than that of a stress data in the other area (e.g., the non-logo area), to be stored closer (or close) to the original data.

Accordingly, it is possible to improve the efficiency of a memory used (or required) in degradation compensation and to increase the accuracy of the degradation compensation with respect to a specific area corresponding to a condition (e.g., a predetermined condition). For example, according to this embodiment, a stress data is accumulated and stored by suitably adjusting (or optimizing) the compression ratio of the stress data for each area, so that it is possible to more efficiently compensate for degradation of the pixels.

By way of summation and review, according to an embodiment an organic light emitting display device includes a plurality of pixels respectively disposed at intersection (or crossing) portions of scan lines and data lines. Each pixel has an organic light emitting diode which emits light with a luminance corresponding to a data signal, thereby displaying an image in a pixel unit.

As time elapses, the organic light emitting diode may become degraded, corresponding to the emission time and luminance (current amount) thereof, and therefore, the emission efficiency of the organic light emitting diode may be deteriorated. If the emission efficiency of the organic light emitting diode is deteriorated, the luminance is decreased. For example, when the decrement of luminance is changed for each pixel, image sticking may occur, and therefore, the image quality is deteriorated. Accordingly, image quality may be improved by appropriately compensating for degradation of the pixels according to the accumulated emission amount of each pixel.

According to the embodiments of the present invention, the image quality is improved by compensating for degradation of the pixels, and at least one portion of a stress data used (or utilized) in degradation compensation is accumulated and stored in the compressed state, so that it is possible to reduce the capacity of the memory used (or utilized) in storing the stress data.

Further, a specific area which requires higher-accuracy (e.g., high-accuracy) degradation compensation, such as a logo area, is detected using (or utilizing) an accumulated stress data, and the stress data corresponding to the specific area is compressed to an extent lower than that of a stress data in the other area (e.g., the non-logo area) so as to be stored closer (or close) to the original data, or the data is stored in the non-compressed state. Accordingly, it is possible to improve the efficiency of the memory used (or required) in degradation compensation and to increase the accuracy of the degradation compensation with respect to a specific area corresponding to a condition (e.g., a predetermined condition).

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims and equivalents thereof.

What is claimed is:

1. An organic light emitting display device, comprising:

a plurality of pixels in a display area;

a data driver configured to supply a data signal to the pixels; and a data converter configured to output a correction image data utilized in generation of the data signal, wherein the data converter is configured to:

generate a stress data corresponding to an input image data, accumulate and store at least a portion of the stress data in a compressed state, based on the stress data, distinguish a first area of the display area from a second area of the display area, the first area corresponding to a first compression extent and the second area corresponding to a second compression extent, compress the stress data corresponding to the first area, and compress the stress data corresponding to the second area differently than the stress data corresponding to the first area;

selectively output an accumulation stress data corresponding to the first area and an accumulation stress data corresponding to the second area, and generate the correction image data obtained by correcting the input image data according to the output accumulation stress data.

2. The organic light emitting display device of claim 1, wherein the data converter comprises:

a gray-stress converter configured to generate the stress data corresponding to the input image data;

a first compressor configured to compress the stress data;

a memory unit configured to accumulate and store the stress data compressed by the first compressor as an accumulated compression stress data;

a first decompressor configured to generate an accumulation stress data by decompressing the accumulated compression stress data stored in the memory unit; and a data compensation unit configured to generate the correction image data obtained by correcting the input image data according to the accumulation stress data.

3. The organic light emitting display device of claim 2, wherein the gray-stress converter is configured to detect the stress data corresponding to the input image data through mapping between the input image data and the stress data.

4. The organic light emitting display device of claim 2, wherein the first compressor is configured to compress the stress data utilizing a linear compression method.

5. The organic light emitting display device of claim 2, wherein the first compressor is configured to compress the stress data for every frame.

6. The organic light emitting display device of claim 2, wherein the memory unit comprises:

a first memory configured to store a stress data compressed by the first compressor for a period; and a second memory configured to continuously accumulate and store the compressed stress data.

7. The organic light emitting display device of claim 6, wherein the first memory is a volatile memory, and the second memory is a non-volatile memory.

8. The organic light emitting display device of claim 2, wherein the first decompressor is configured to generate the accumulation stress data by decompressing the accumulated compression stress data for every frame.

9. The organic light emitting display device of claim 2, wherein the data compensation unit is configured to calculate a correction value of the input image data, utilizing a function determined with respect to the output accumulation stress data.

10. An organic light emitting display device, comprising:

a plurality of pixels in a display area;

a data driver configured to supply a data signal to the pixels; and a data converter configured to:

output a correction image data utilized in generation of the data signal;

generate a stress data corresponding to an input image data;

accumulate and store at least a portion of the stress data in a compressed state; and generate the correction image data obtained by correcting the input image data according to the accumulated stress data, wherein the data converter comprises:

a gray-stress converter configured to generate the stress data corresponding to the input image data;

a first compressor configured to compress the stress data;

a memory unit configured to accumulate and store the stress data compressed by the first compressor as an accumulated compression stress data;

a first decompressor configured to generate an accumulation stress data by decompressing the accumulated compression stress data stored in the memory unit;

a data compensation unit configured to generate the correction image data obtained by correcting the input image data according to the accumulation stress data;

a logo detector configured to detect a logo area of the display area, utilizing the accumulated compression stress data or the accumulation stress data, and to control the stress data corresponding to the logo area to be separately accumulated and stored; and a multiplexer configured to selectively output, to the data compensation unit, an accumulation stress data corresponding to the logo area and an accumulation stress data corresponding to a non-logo area.

11. The organic light emitting display device of claim 10, wherein the memory unit comprises:

a first memory configured to store a stress data compressed by the first compressor for a period;

a third memory configured to store a compression stress data or a non-compression stress data corresponding to the logo area for a period; and a second memory configured to continuously accumulate and store the compression stress data or the non-compression stress data supplied via the first and third memories.

12. The organic light emitting display device of claim 10, wherein the data converter further comprises:

a second compressor configured to compress the stress data corresponding to the logo area and to output the compressed stress data to the memory unit; and a second decompressor configured to generate an accumulation stress data by decompressing the accumulated compression stress data corresponding to the logo area, stored in the memory unit, and to supply the generated accumulation stress data to the multiplexer.

13. The organic light emitting display device of claim 1, wherein the data converter is configured to accumulate and store the stress data in a compressed or anon-compressed state by distinguishing a logo area from a non-logo area, and to generate the correction image data obtained by correcting the input image data according to the accumulated stress data.

14. A method of driving an organic light emitting display device, the method comprising:

generating a stress data corresponding to an input image data;

distinguishing a first area from a second area based on the stress data, the first area corresponding to a first compression extent and the second area corresponding to a second compression extent;

generating a compression stress data by compressing the stress data corresponding to the first area, and compressing the stress data corresponding to the second area differently than the stress data corresponding to the first area;

generating an accumulated compression stress data by accumulating and storing the compression stress data;

generating an accumulation stress data by decompressing the accumulated compression stress data;

selectively output an accumulation stress data corresponding to the first area and an accumulation stress data corresponding to the second area;

correcting the input image data according to the output accumulation stress data, and outputting the corrected input image data as a correction image data; and generating a data signal corresponding to the correction image data, and supplying the generated data signal to pixels.

15. The method of claim 14, wherein the generating of the stress data comprises detecting the stress data corresponding to the input image data through mapping between the input image data and the stress data.

16. The method of claim 14, wherein the generating of the compression stress data comprises compressing the stress data utilizing a linear compression method.

17. The method of claim 14, wherein the correcting of the input image data comprises calculating a correction value of the input image data utilizing a function determined with respect to the output accumulation stress data.

18. The method of claim 14, further comprising detecting the first area as a logo area, utilizing the accumulated compression stress data or the accumulation stress data, and accumulating and storing the stress data corresponding to the logo area to be separated from a stress data in a non-logo area.

19. The method of claim 18, wherein the stress data corresponding to the logo area is accumulated and stored in a non-compressed state to be utilized in generation of the correction image data.

20. The method of claim 18, wherein the stress data corresponding to the logo area is compressed at a compression ratio different from that of the stress data corresponding to a non-logo area and then accumulated and stored, and the accumulated compression stress data is decompressed to be utilized in the generation of the correction image data.

* * * * *